US012590420B1

(12) United States Patent
Birgen

(10) Patent No.: US 12,590,420 B1
(45) Date of Patent: Mar. 31, 2026

(54) PLASTIC-EATING PATCH/LABEL

(71) Applicant: William J Birgen, Tempe, AZ (US)

(72) Inventor: William J Birgen, Tempe, AZ (US)

( * ) Notice: Subject to any disclaimer, the term of this patent is extended or adjusted under 35 U.S.C. 154(b) by 175 days.

(21) Appl. No.: 18/504,965

(22) Filed: Nov. 8, 2023

Related U.S. Application Data

(60) Provisional application No. 63/423,973, filed on Nov. 9, 2022.

(51) Int. Cl.
*D21H 27/10* (2006.01)
*D21H 21/14* (2006.01)
*D21H 27/32* (2006.01)

(52) U.S. Cl.
CPC ..... *D21H 27/10* (2013.01); *D21H 21/14* (2013.01); *D21H 27/32* (2013.01)

(58) Field of Classification Search
CPC ..... D21H 27/10; D21H 21/14; D21H 27/32
See application file for complete search history.

(56) References Cited

U.S. PATENT DOCUMENTS

2004/0013866 A1* 1/2004 Sasaki ..... B01J 20/28033
428/318.4

FOREIGN PATENT DOCUMENTS

CN 1238285 A * 12/1999
CN 212268324 U * 1/2021

OTHER PUBLICATIONS

CN-1238285-A English translation provided by Espacenet (Year: 2025).*
CN-212268324-U English translation provided by Espacenet (Year: 2025).*

* cited by examiner

*Primary Examiner* — Abbas Rashid
*Assistant Examiner* — Elisa H Vera
(74) *Attorney, Agent, or Firm* — Venjuris, P.C.

(57) ABSTRACT

This invention is a laminate patch, label or packaging material which contains plastic eating elements, which can clean up polluted sites with plastic waste and can reduce the footprint of plastic in landfills. This invention containing plastic eating elements, can be deployed as a printed label, or a consumer product added to trash bags, or integrated into a product or its packaging.

17 Claims, 3 Drawing Sheets

PLASTIC-EATING PATCH/LABEL

FIELD OF THE INVENTION

This invention relates to packaging and packaging materials. More specially, this invention relates to packaging materials that break-down after use.

BACKGROUND OF THE INVENTION

Plastic waste is a problem. Plastic collects in landfills, in the ocean and otherwise litters the landscape.

SUMMARY OF THE INVENTION

This invention is embodied in a packaging material that houses plastic-eating elements, which are typically freeze-dried. The plastic eating elements are preferably enzymes, proteins, or fungi that eat plastics. The packaging material can then be used to package or label goods in the ordinary way. But when the packaging material gets thrown away (or otherwise disposed of), the plastic eating elements get activated via wetting and consume the packaging material itself or other plastic in the garbage bin or landfill.

In one embodiment, the packaging material is a double-ply packaging material that houses freeze-dried plastic eating elements sandwiched between the two plies. The double-ply material is preferably made from paper or cellulose.

In another embodiment, the freeze-dried plastic eating elements are stored in a packet and the packet is adhered to the packaging material.

In another embodiment, the freeze-dried plastic eating elements are added to a label, covered by the label, or added to the adhesive that is used to still the label to the item.

In another embodiment, the freeze-dried plastic eating elements are suspended within a tissue substrate. The tissue could be kept in a facial-tissue style box. A user could then add one tissue at a time to a trash bag to initiate breakdown of the plastic items in the trash bag.

In all of these embodiments, the plastic eating elements get activated once the material covering the plastic eating elements breaks down and the plastic eating elements get wet.

DETAILED DESCRIPTION OF THE PREFERRED EMBODIMENT

Figure 1:
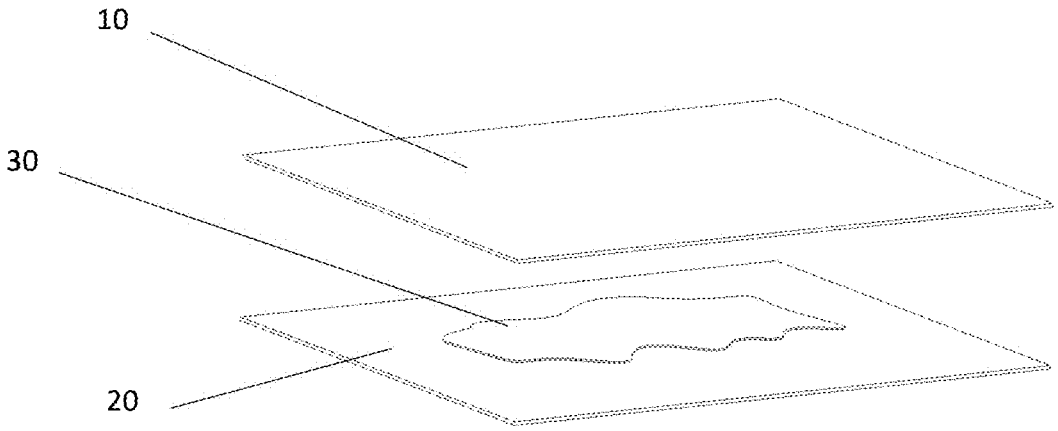
FIG. 1: Exploded View, Two Plies

The purpose of this invention is to introduce plastic-eating elements to discarded plastic (that is, plastic that has been "thrown out"). This could be plastic in a garbage bin, in a land-fill, litter, or anywhere plastic waste can be found. By creating packaging and/or labeling with plastic-eating elements imparted unto them, this packaging can eat itself after disposal or, if the packaging is not plastic, it can eat other plastic waste which may be encountered.

For the purposes of this specification, the term "plastic eating element" broadly refers to plastic-eating enzymes, proteins that create plastic-eating enzymes, fungi, or fungi spores that eat plastics. Plastic eating elements are known. For example, the following enzymes and proteins are known to consume plastic are known: PET Hydrolases, PETase (N233K/R224Q/S121E), PETase (D186H/R280A), Ideonella sakaiensis 201-F6, FAST PETase, Dura S121E, and WT S121E. Likewise, fungi, such as pestalotiopis microspore, can also behave in a similar plastic-eating manner.

This invention may be integrated with plastic or partial plastic packaging. It is important, though, for the packaging material to remain dry until the waste cycle begins, so the enzyme does not begin to consume/process/digest/ruminate the plastic prematurely. The enzyme is ideally isolated from any plastic portion of its own construction platform until it becomes waste, i.e. after its intended use/life at which time it is safe for the plastic to break down.

Typically, plastic eating elements have a 1-year life once activated. Thus, it is preferable to keep the plastic eating elements in hibernation until they are needed to break down plastic. The preferred way to do this is to freeze dry (to form a powder) the plastic-eating elements prior to integration with the label or packaging substrate. Doing so, delays activation until the plastic eating enzymes are wetted. Dehydrating or drying the plastic eating elements would also work.

When the embodiment housing the plastic eating element is not made from plastic, the plastic eating element will reanimate when it becomes wet, just like other embodiments, but will rely on consuming plastic which was not part of its embodiment. That is, the plastic eating element will consume plastic located in the same garbage bag or nearby in a landfill. When the plastic eating element comes into contact with the appropriate plastic, after reanimating, it will receive sustenance from the plastic outside of its housing, as it consumes the plastic. When all plastic in the environment of the plastic eating element is processed, the plastic eating element will eventually starve and die. For cases when the housing contains no plastic there is a randomness assumed as to whether or not the enzyme will encounter plastic at all. It is probable that many such embodiments, without plastic, will never encounter plastic for consumption. In these embodiments, for economic reasons, relatively small quantities of freeze-dried enzyme powder should be employed, e.g. 3-5 grams.

Knowing that not all embodiments of the invention will encounter plastic waste, merits this economical solution. In cases where the embodiment is intended as a patch for consumers to place in their garbage bag (e.g.) it is nearly certain the invention will encounter plastic. For these cases, small amounts of enzyme may also be deployed as the enzyme will multiply and spread as it feeds on the plastic present. Alternatively, it may be desired to process the plastic waste more quickly, which would merit a larger quantity of enzyme, say 50 grams. Furthermore, the dissemination of the imbued enzyme could have broader reach and faster efficacy should the enzyme content be 1,000 grams. This embodiment would be desired when the probability of reaching large quantities of plastic is nearly certain.

There are several different scenarios where this solution could be deployed. First, a user may want to delay activation for a long period of time. In that case, the housing that envelops the plastic eating element should be made from a non-permeable material.

The preferred embodiment for this scenario is a double-ply material paper with freeze-dried plastic eating element (powder) sealed in-between the two plies. FIG. 1 illustrates such a two-ply embodiment. A first ply 10 and a second ply 20 could both be a non-permeable (waterproof) ply. The first ply 10 could be made from polyvinyl chloride. Or the first ply could be a waterproof coating such as thermoplastic olefin or polypropylene. The first and second plies (10, 20) could be adhered to each other, heat welded to each other, staked, riveted, or other suitable joining method. The plastic eating element 30 is preferably distributed evenly between the plies. Depending on the materials used, it may be some time (months to years) before the plies break down and allow moisture to reach the plastic eating element.

Figure 2:
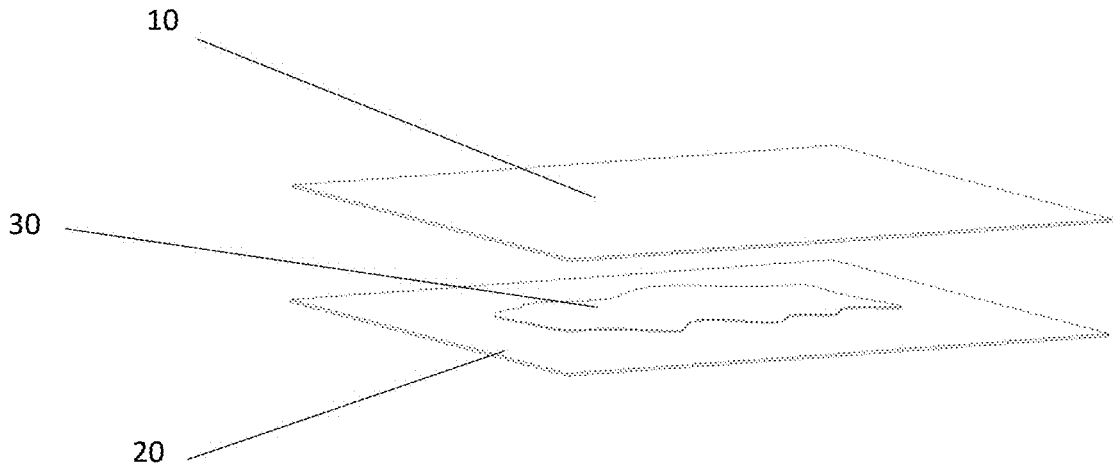
FIG. 2: Exploded View, Two Plies, not waterproof

In second scenario, the user may want one or more sections/sides to be permeable. For example, the first ply 10 could be a paper or cellulose material and the second ply 20 could be non-permeable. One of the benefits of paper or cellulose is that it provides a structure for the plastic eating element 30. In this scenario, once moisture reaches the plastic eating element 30, it will activate it. This embodiment is illustrated in FIG. 2. FIG. 2 illustrates a two-ply solution where the first ply 10 and the second ply 20 are both made from paper or cellulose material. The edges of the plies can be pressure bonded together. This embodiment may be useful for devices that are housed in plastic but stay dry (e.g., electronic devices). In this way, the plastic eating element won't get activated during the useful life of the device, but will activate once the device reaches the landfill and gets wetted.

In a third scenario, a user may want to place the plastic eating element on the inside face of a label (e.g. on a soft-drink bottle). The label itself is a laminate, where the plastic eating elements (proteins, bacterium, and or fungi) are protected from water (weather that water be in the form of condensation, submersion or ice) within the inner plies of the laminate construction. The outside ply is suitable for printing label information and the opposite ply is equipped with an adhesive. Alternatively, one of the plies may be the label with the opposite ply being the plastic bottle itself, with the plastic eating element sandwiched between. In addition to bottled beverages, this label embodiment may be affixed to a plastic appliance like a coffee maker or vacuum cleaner.

Figure 3:
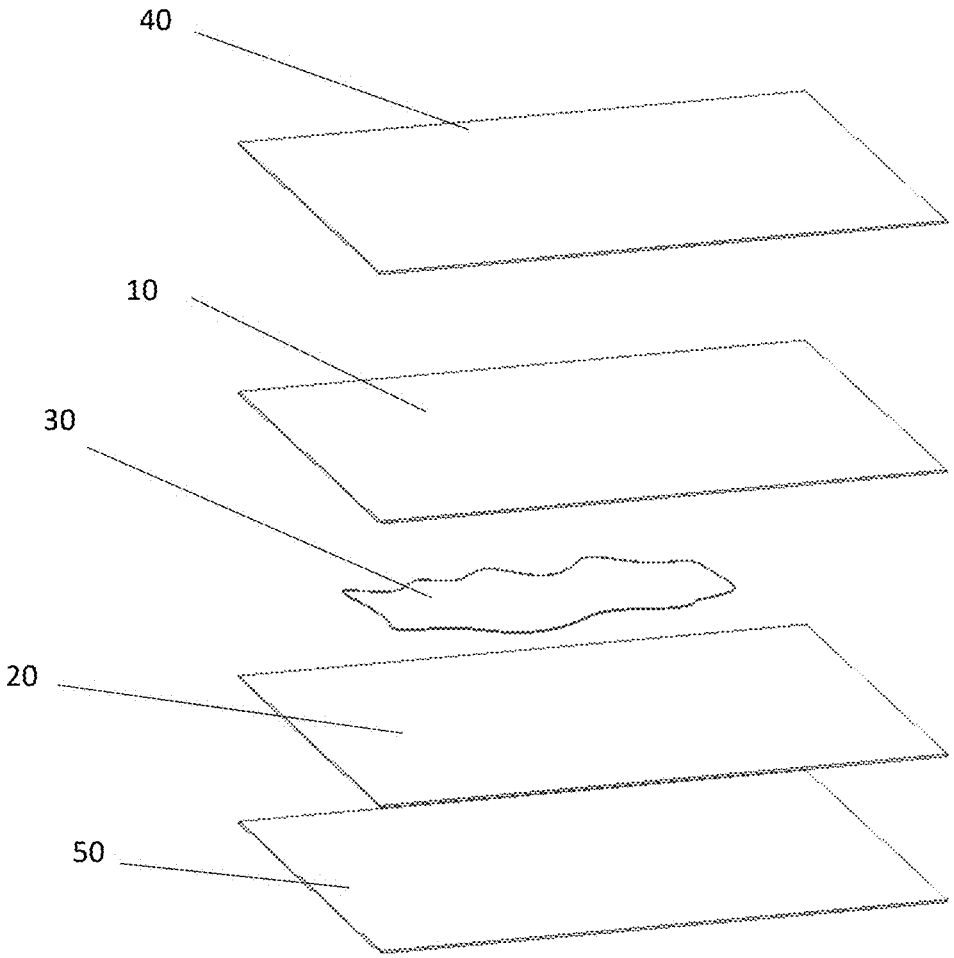
FIG. 3: Exploded View, Four Plies

FIG. 3 illustrates a multi-ply embodiment suitable for a label. Like the previous embodiments, FIG. 3 comprises a plastic eating element 30 evenly distributed between the first ply 10 and the second ply 20. In this multi-ply embodiment, is preferred that the first ply 10 comprises a paper product that can provide some structure for the plastic eating element 30. Alternatively, the first ply 10 could be a spray on adhesive or 2-sided adhesive tape. The second ply 20 could also comprise paper, spray adhesive, or tape. A third ply 40 could be applied on top of the first ply 10. The third ply 40 is preferably a waterproof ply, PLA or equivalent, for printing label information and keeping plastic-eating element dry. A fourth ply 50 is preferably a release ply that temporarily covers the second ply 20, but gets removed prior to sticking it to a substrate. In this way, a plastic item (like a bottle) can be labeled in the ordinary way. When the label is adhered to the bottle, the plastic eating enzyme won't get activated. But once the label starts to peel away, moisture will find its way to the plastic eating element 30 and activate it.

Alternatively, one of the plies may be a sprayed-on sealant, wax, or adhesive. The laminate maybe be paper, cellulose, plastic or a combination laminate. This invention may be executed as a drop in patch, or a patch with an adhesive backing, labeling or as packaging substrate imbued with plastic eating enzyme(s).

A fourth scenario can occur when the user wants the plastic eating element to be activated immediately. It is important to note that activating the plastic eating element will not immediately dissolve the plastic. It takes weeks or months for this to occur. This solution would work well in a garbage bag. For example, a plastic eating element could be suspended within a facial-tissue style substrate. To make this embodiment, the plastic eating element can be added to the pulp slurry before the tissue is formed. This is the most preferred method, as it ensures that the powder is evenly distributed throughout the tissue. Alternatively, plastic eating element can be applied to the surface of the tissue after it has been formed.

In operation, the tissue could be kept in a facial-tissue style box. A user could then add one tissue at a time to a trash bag to initiate breakdown of the plastic items in the trash bag. An advantage of a tissue structure is its inherent hygroscopic nature, accelerating the introduction of water from outside, to the plastic eating element.

Alternatively, instead of a facial-tissue style substrate, the plastic eating enzyme could be dropped into a paper sachet, containing between 5 and 1,000 grams of plastic eating enzyme, fungi, or protein. This sachet contains freeze dried enzyme between two plies of paper held together via a process using elevated pressure, though many techniques may be employed including folding, stitching, adhesive, etc.

Figure 4:
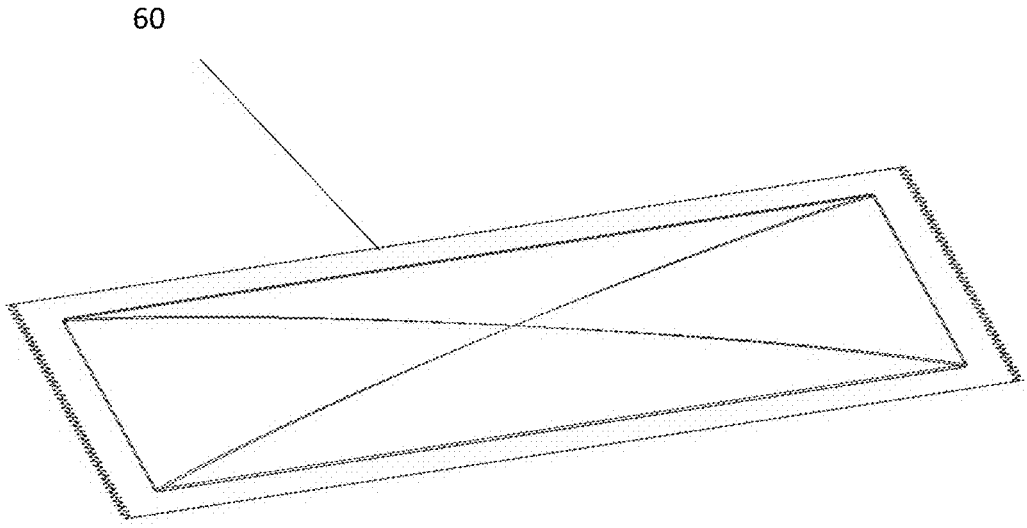
FIG. 4: Paper Packet

FIG. 4 illustrates a paper packet 60. The paper packet can be folded and sealed in a variety of ways to hold the plastic-eating element 30.

Yet another embodiment is a cardboard or structural paper or cellulose with plastic eating elements (freeze dried) suspended within its fibers. In this embodiment, the enzyme is not sealed from moisture, as it is not necessary, given the typical application of cardboard boxes. Just the same, this cardboard embodiment may yet still employ a waterproof coating or treatment.

Combining the plastic eating element with an absorbent powder compound could accelerate the reanimation/hydration of the plastic eating element. Examples of such absorbent powders include sodium polyacrylate (sometimes known as SAP), polyglutamic acid gel, or kappa carrageenan. Other absorbent powders known in the art could also be suitable. All these absorbent powder compounds can absorb over 10 times their dry mass in water mass. Combining one or more of these superabsorbent powders with the plastic eating element in any of the embodiments disclosed herein can be effective. In operation, it is preferred to mix at least 1 gram of absorbent powder for every 10 grams of plastic eating element. The preferred upper limit would not exceed a one for one ratio of absorbent powder to plastic eating element.

Likewise, a porous wicking ply could serve in a similar manner to expedite the hydration and reanimation in any of the embodiments disclosed herein.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A packaging material, the packaging material comprising:

a first ply and a second ply connected along a common perimeter, and a deposit of freeze-dried, dehydrated, or dried plastic eating elements selected from the group comprising proteins, enzymes, bacteria, fungi, or fungi spores, wherein the deposit is a separate component positioned and contained between the first and second plies.

2. The packaging material of claim 1, the first ply comprising paper or cellulose.

3. The packaging material of claim 1, the first ply comprising a non-permeable material.

4. The packaging material of claim 2, the second ply comprising a non-permeable material.

5. The packaging material of claim 2, the second ply comprising paper or cellulose.

6. The packaging material of claim 3, the second ply comprising a non-permeable material.

7. The packaging material of claim 1, the second ply comprising an outside face, the outside face comprising an adhesive.

8. The packaging material of claim 1 further comprising a third ply, the third ply comprising a product label.

9. The packaging material of claim 4 further comprising a fourth ply, the fourth ply comprising backer configured to temporarily cover adhesive on the second ply.

10. The packaging material of claim 1 further comprising an absorbent powder mixed with the deposit, wherein the absorbent powder is configured to accelerate hydration of the deposit.

11. The packaging material of claim 10, the absorbent powder selected from the group comprising polyglutamic acid gel, sodium polyacrylate, and kappa carrageenan.

12. The packaging material of claim 1, wherein the first and second plies are comprised of a paper tissue, and wherein the packaging material is configured as an additive for a trash bag to degrade plastic items in the trash bag.

13. The packaging material of claim 1, wherein the plastic eating elements are selected from the group consisting of PET Hydrolases and PETase.

14. A trash bag additive for degrading plastic items within a trash bag, the trash bag additive comprising:

a hygroscopic tissue comprising paper and a deposit of freeze-dried, dehydrated, or dried plastic eating elements suspended within the tissue, wherein the hygroscopic tissue is configured to accelerate hydration of the deposit upon exposure to moisture.

15. The trash bag additive of claim 14 further comprising an absorbent powder mixed with the deposit, wherein the absorbent powder is configured to further accelerate hydration of the deposit.

16. The trash bag additive of claim 15, the absorbent powder selected from the group comprising polyglutamic acid gel, sodium polyacrylate, and kappa carrageenan.

17. The trash bag additive of claim 14, wherein the plastic eating elements are selected from the group consisting of PET Hydrolases and PETase.

* * * * *